US006207918B1

(12) United States Patent
Lorenz et al.

(10) Patent No.: US 6,207,918 B1
(45) Date of Patent: Mar. 27, 2001

(54) COMPRESSED GAS POWER SWITCH

(75) Inventors: Dieter Lorenz; Bernd-Ulrich Habedank, both of Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/214,646

(22) PCT Filed: Jul. 9, 1997

(86) PCT No.: PCT/DE97/01471

§ 371 Date: Sep. 10, 1999

§ 102(e) Date: Sep. 10, 1999

(87) PCT Pub. No.: WO98/01877

PCT Pub. Date: Jan. 15, 1998

(30) Foreign Application Priority Data

Jul. 10, 1996 (DE) ..... 196 29 475

(51) Int. Cl.[7] ..... H01H 33/80; H01H 33/88

(52) U.S. Cl. ..... 218/59; 218/60; 218/65; 218/66

(58) Field of Search ..... 200/302.2; 218/43–84

(56) References Cited

U.S. PATENT DOCUMENTS 3,789,175 * 1/1974 Beier et al. ..... 218/62
4,293,750 * 10/1981 Marin ..... 218/66
4,633,049 * 12/1986 Pinnekamp ..... 218/66 X
4,652,709 * 3/1987 Schade ..... 218/46
4,663,504 * 5/1987 Barkan ..... 218/57
5,285,036 * 2/1994 Lorenz ..... 218/61
5,742,016 * 4/1998 Rolff ..... 218/61
5,898,149 * 4/1999 Berger et al. ..... 218/60

FOREIGN PATENT DOCUMENTS 23 50 832 4/1975 (DE) .
40 10 007 10/1991 (DE) .
41 03 119 8/1992 (DE) .
0 334 181 9/1989 (EP) .
0 400 523 12/1990 (EP) .
92 14255 8/1992 (WO) .

* cited by examiner

*Primary Examiner*—J. R. Scott
(74) *Attorney, Agent, or Firm*—Kenyon & Kenyon

(57) ABSTRACT

The invention relates to a compressed gas switch with two contact pieces, a contact element by-passing the contact pieces when in the on position, and two isolating distances connected to each other in series. The second contact piece opposing the first isolating distance is arranged axially by an annular piston to be displaceable forming a switching chamber. The switching chamber is separated from the heating chamber by a bulkhead partition having a current-dependent valve, and the second isolating distance is produced after opening of a blowing hole located between the second contact piece and the contact element.

9 Claims, 3 Drawing Sheets

COMPRESSED GAS POWER SWITCH

FIELD OF THE INVENTION

The present invention relates to a compressed gas power switch, in particular for extinguishing an arc of a high short-circuit current, which has a first switching piece and a second switching piece, installed on a common axis with a space between them, and an axially displaceable contact piece, which bridges the space when in the on state and moves away from the first switching piece during switch-off, and is at least partially surrounded by a heating chamber, a second isolating distance being connected in series to a first isolating distance formed between the first switching piece and the contact piece during switch-off.

BACKGROUND INFORMATION

A compressed gas switch is described in principle, for example, in German Patent No. 40 10 007 regarding the contact arrangement and the operation of the axially displaceable contact piece. A heating chamber arranged coaxially with the contact arrangement is described in German Patent No. 41 03 119. Regardless of the particular design of these compressed gas switches, they have the disadvantage that the hot gas makes it difficult to establish the isolating distance during switch-off, so that the time at which the isolating distance is re-established cannot be determined with sufficient accuracy. In addition, controlled switching at zero current is almost impossible, since the inherent delay of the compressed gas power switch is included in the switching sequence (each compressed gas power switch has a different inherent delay determined by the respective manufacturing tolerances, age, environmental conditions, and different masses). European Patent No. 0 334 181 and European Patent No. 0 400 523 describe that a second isolating distance may be connected in series to the first isolating distance of a compressed gas power switch, but this involves a disproportionately large, and therefore high-cost, drive, since the extinguishing gas may only enter the inside containing the secondary contact of the second isolating distance from the outside. This, however, means not only that gas must be made available from the outside, but also that the compressed gas power switch requires a large space.

SUMMARY OF THE INVENTION

An object of the present invention is to provide a compressed gas power switch which allows reliable switching with low drive power and adequate re-establishment of the isolating distance to be achieved regardless of its particular inherent delay or the hot gas in the heating chamber, yet without an increase in the volume occupied by the compressed gas power switch.

This object is achieved according to the present invention by the fact that the second switching piece is axially displaceable and is connected to a piston that may be driven in a switching chamber in respect to the contact piece by the hot gas flowing from the heating chamber into the switching chamber so that the second switching piece moves away from the contact piece.

This provides drive support, since the second switching piece is moved by the extinguishing gas pressure. In addition, the operation of the second switching piece depends on the extinguishing gas and therefore on the current, so that the opening of the second isolating distance is controlled by the characteristics of each individual switching sequence.

According to one advantageous embodiment of the present present invention, the heating chamber is separated from the switching chamber by a bulkhead, which has a valve controllable through the current to be switched and the pressure difference between the heating chamber and the switching chamber. The valve allows the opening time of the second isolating distance to be controlled with an even greater accuracy.

The present invention may also be advantageously configured so that the second switching piece is axially displaceable on the inner periphery of a tubular main current path connected to the compression piston of a compression device forming a sliding contact, the second isolating distance being formed between the second switching piece and the axially displaceable contact piece after a blow hole has been opened by the current-dependent valve via the hot gas driving the piston designed as an annular piston.

Regardless of how the heating chamber is designed, the annular piston in the switching chamber may be connected to the compression piston of the compression device via a compression spring, so that after the completion of a switch-off sequence, it is ensured that the compression spring brings the annular piston and the switching piece connected to it back to their original position.

In order to provide a sufficiently large heating chamber for receiving the hot gases, in particular when switching high short-circuit currents, in another embodiment of the invention the switching chamber downstream from the heating chamber is delimited by a partition running coaxially with the switch axis, which is rigidly connected to both the bulkhead and the compression piston of the compression device, so that an additional heating chamber, connected to the heating chamber upstream from the bulkhead, is formed on the outer periphery of the partition.

According to another feature of the present invention, the valve has one or two ferromagnetic bodies, which in the high-current phase hold the blow hole in the bulkhead closed against the force of compression springs, but open it when the current has reached a certain lower value. The forces of the current of the current path of the compressed gas power switch, i.e., the forces between the two ferromagnetic bodies in a magnetic field (a concentric magnetic field formed around the compressed gas power switch current path due to the short-circuit current to be switched off) may be used.

In order to make use of the forces of the current, a ferromagnetic body in the form of a cover plate over the blow hole may be slidably arranged to form a valve. The cover plate is supported by the compression springs against the current path formed by the switching piece and the axially movable contact piece and its movement is limited by a stop. To guide the ferromagnetic cover plate taking into account a slight friction resistance, it is mounted on tracks or in grooves, preferably made of polytetrafluoroethylene (PTFE).

The current-dependent valve may also be conveniently made of two cover plates made of ferromagnetic material, which oppose one another at the end face of the bulkhead facing the switching chamber at the height of the blow hole and support one another through compression springs.

Both embodiments of the current-dependent valve are also well suited for arrangement on the annular piston at the height of the blow hole; however, in this case it must be ensured that, at least in the area of the current-dependent valve, the annular piston not be made of magnetic material.

Using the forces arising between two ferromagnetic bodies in a magnetic field, in a preferred embodiment of the invention, the current-dependent valve may also be made of a frame made of ferromagnetic material, arranged concentrically with the blow hole within the bulkhead and for which a cover plate made of ferromagnetic material is provided on the side facing the heating chamber upstream from the blow hole. This cover plate is preferably guided by four rods attached to the bulkhead and supported against the bulkhead by compression springs.

DETAILED DESCRIPTION

Figure 1:
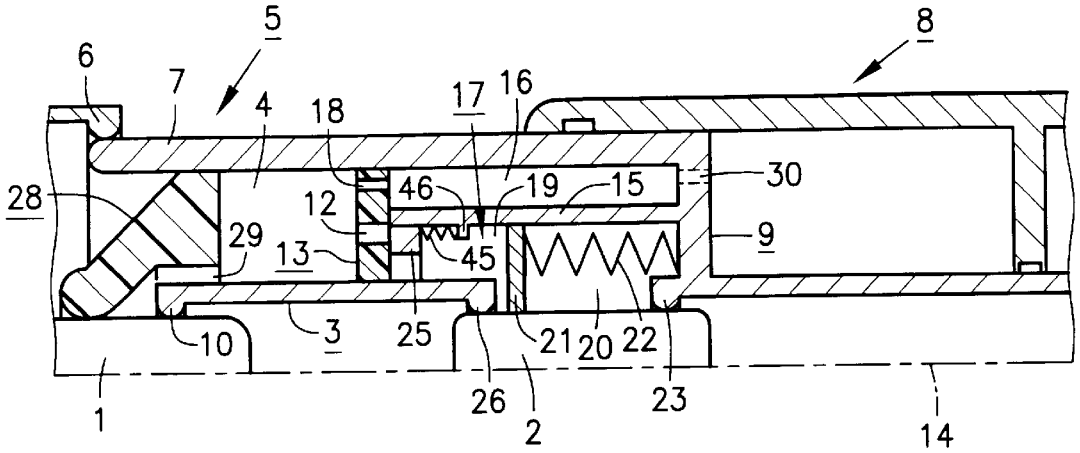
FIG. 1 shows a section of a compressed gas power switch according to the present invention in the on position.
Figure 2:
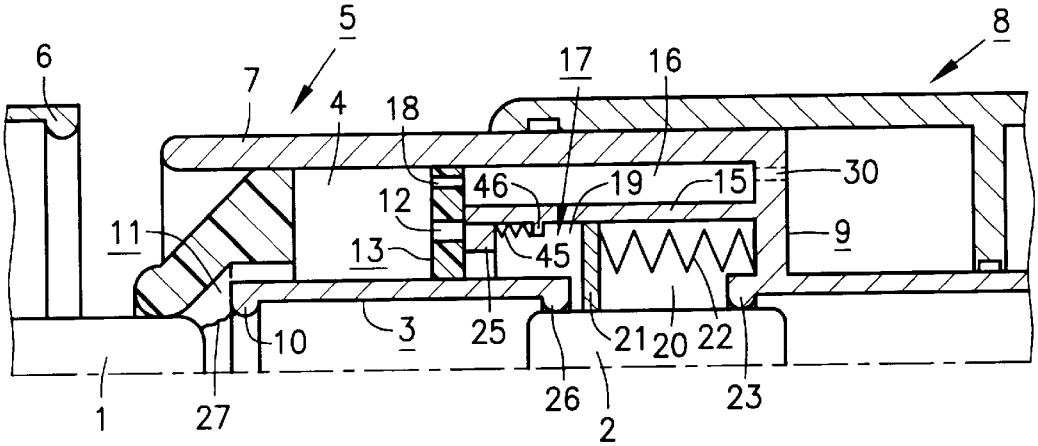
FIG. 2 shows a section of a compressed gas power switch according to the present invention after the first isolating distance is formed in the area of its contact arrangement.
Figure 3:
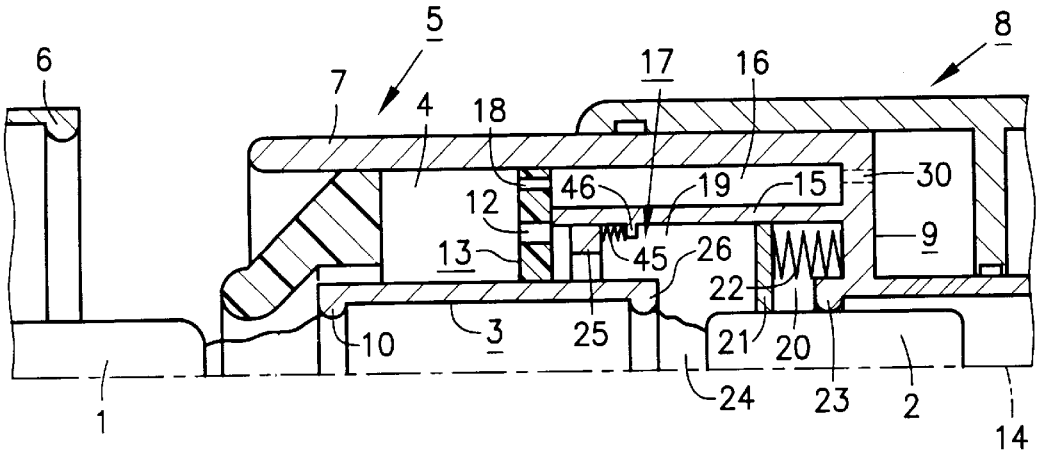
FIG. 3 shows a section of a compressed gas power switch according to the present invention in the off position.

As FIGS. 1 through 3 show, the compressed gas power switch has basically two pin-shaped switching pieces 1, 2 mounted on a common axis, which may also have a tubular design; an axially movable contact piece 3, which coaxially surrounds and, in the on state, bridges the switching pieces; a first heating chamber 4 concentric with contact piece 3; main current path 5 with stationary rated current contact 6; movable rated current contact 7; and compression device 8 with compression piston 9.

While FIG. 1 shows the compressed gas power switch in the on position, in FIG. 2 the contact arrangement assumes a position in which, after the previous opening of main current path 5, the first isolating distance 11 is formed after the subsequent separation of sliding contact 10 of contact piece 3 from switching piece 1. FIG. 3 shows the compressed gas power switch in the off position.

Based on this principle of the design of the compressed gas power switch, contact piece 3 is now fixedly connected to the area of main current path 5 carrying movable rated current contact 7, and thus to axially displaceable compression piston 9 through a bulkhead 13, made of insulating material and having a blow hole 12. The space behind bulkhead 13 is subdivided by a partition 15, coaxial with switch axis 14, into a heating chamber 16 and a switching chamber 17. While heating chamber 16 is connected to first heating chamber 4 through an opening 18 in bulkhead 13 thus forming an additional heating volume, partition 15 is fixedly connected with both bulkhead 13 and compression piston 9, and accommodates, in an axially displaceable manner, an annular piston 21, fixedly connected to second switching piece 2 and subdividing switching chamber 17 into two partial chambers 19, 20. Annular piston 21 is under the effect of a compression spring 22 arranged in partial chamber 20. As further shown by FIGS. 1 through 3, compression piston 9 is connected to switching piece 2 via a sliding contact 23, and the second isolating distance 24 is formed after the blow hole 12 has been opened by a current-dependent valve after the first isolating distance 11 has been opened by switching piece 2 and by sliding contact 26 of the axially displaceable contact piece 3.

If a switch-off operation is to be performed on the basis of this embodiment of the compressed gas power switch, the main current path is opened first. If the distance between rated current contacts 6, 7 is sufficient, first isolating distance 11 opens and arc 27 is formed. The arc 27 heats the gas in heating chamber 4 delimited by isolating material nozzle 28 with its flow duct, so that the pressure of the gas increases and, since blow hole 12 is initially closed by the current-dependent valve, it is built up further. As the switch-off current approaches zero, the force acting on current-dependent valve 25 decreases and blow hole 12 is opened toward partial chamber 19 of switching chamber 17. Therefore, the gas flows from heating chamber 4, and thus also from additional heating chamber 16 into partial chamber 19, acts upon annular piston 21 actuating this piston, and thus second switching piece 2, opening second isolating distance 24 between switching piece 2 and contact piece 3. Since the current resulting from arc 27 of the first isolating distance 11, is near zero crossing at this point, the extinguishing capability of second isolating distance 24 is not very high. Additional extinguishing gas may be supplied from compression device 8 via opening 30 in compression piston 9.

Thus the invention provides controlled switching at zero current independently of the inherent delay of the compressed gas power switch, using low drive power. This results not only in reliable reestablishment of the isolating distance, but also the effects aimed at by the invention are achieved without an increase in the size of the compressed gas power switch.

Figure 4:
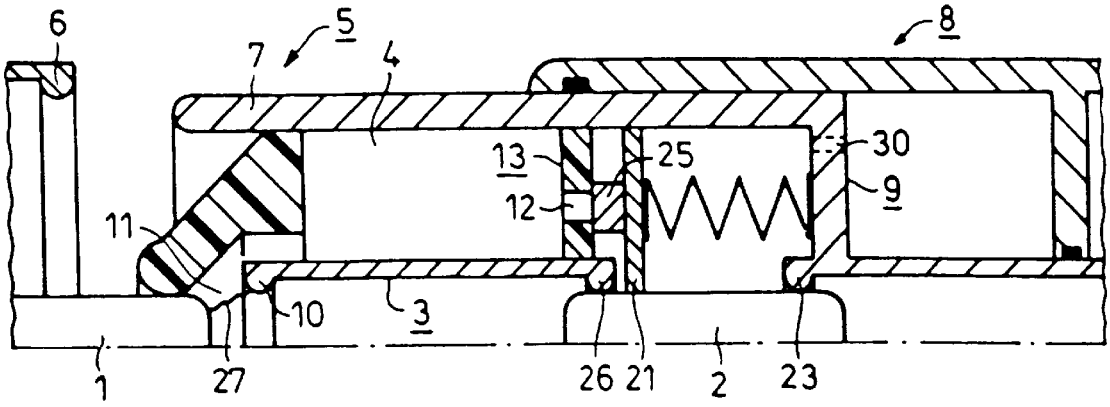
FIG. 4 shows a section of a compressed gas power switch with a first isolating distance and having a design different than FIGS. 1 through 3 in the area of its contact arrangement.
Figure 5:
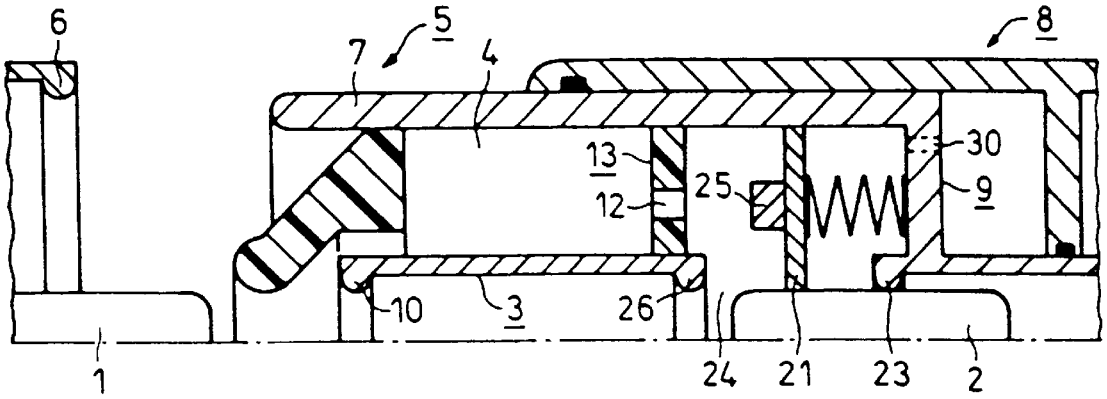
FIG. 5 shows a section of a compressed gas power switch with a second isolating distance and having a design different than FIGS. 1 through 3 in the area of its contact arrangement.

These effects of the compressed gas power switch are also achieved according to the embodiment of FIGS. 4 and 5. While FIG. 4 shows the switch position assumed during a switch-off sequence, in which first isolating distance 11 is already effective, FIG. 5 shows the compressed gas power switch in the switch position in which second isolating distance 24 is already open. This compressed gas power switch differs from that of FIGS. 1 through 3 basically by the fact that the current-dependent valve is directly attached to annular piston 21, which is fixedly connected to switching piece 2 at the height of blow hole 12 in bulkhead 13, and annular piston 21 (and therefore also switching piece 2) is accommodated in an axially displaceable manner by the area of main current path 5 carrying rated current contact 7.

Current-dependent valve 25 according to FIGS. 1 through 5 may be either a current-dependent valve 31 using the forces of the current or a valve 32, 33.

Figure 6:
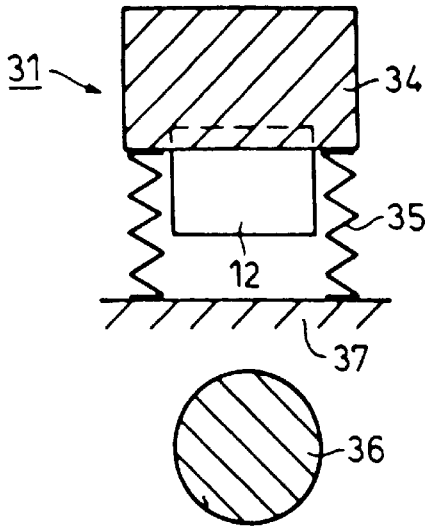
FIG. 6 shows a cross sectional view of a first embodiment of the current-dependent valve of the compressed gas power switches shown in FIGS. 1 through 5.

In current-dependent valve 31 using the forces of the current according to FIG. 6, a cover plate 34, made of ferromagnetic material, is displaceably arranged over blow hole 12 and is supported by compression springs 35 against current path 36 formed by switching pieces 1, 2 and contact piece 3. The movement of the cover plate 34 is limited by a stop 37.

Figure 7:
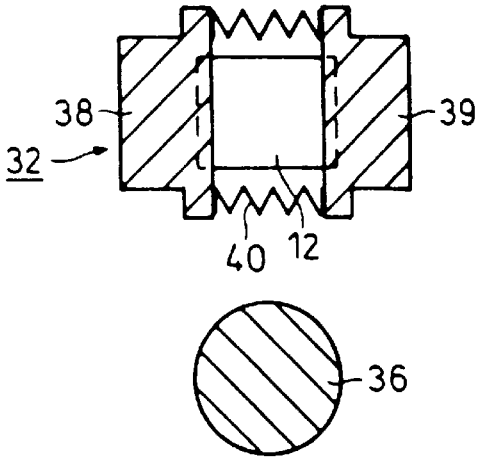
FIG. 7 shows a cross sectional view of a second embodiment of a current-dependent valve of the compressed gas power switches shown in FIGS. 1 through 5.

Current-dependent valve 32 shown by FIG. 7 makes use of the forces generated between two ferromagnetic bodies in a magnetic field. Thus, two cover plates 38, 39, made of ferromagnetic material, oppose one another at the height of blow hole 12 and are also supported by one another via compression springs 40. Both current-dependent valve 33 and the one of FIG. 6 are particularly well suited when the current-dependent valve is to be arranged on annular piston 21.

Figure 8:
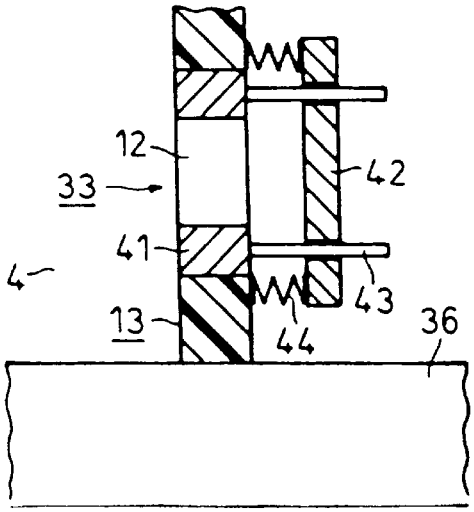
FIG. 8 shows a third embodiment of the current-dependent valve of the compressed gas power switches shown in FIGS. 1 through 5.

Current-dependent valve 33 of FIG. 8 also makes use of the forces generated between two ferromagnetic bodies in a magnetic field. In this current-dependent valve 33, a frame 41 made of ferromagnetic material is provided concentrically with the blow hole 12 within bulkhead 13. Furthermore, upstream from blow hole 12, a cover plate 42 made of ferromagnetic material, guided by rods 43 attached to frame 41 and supported by compression springs 44 against bulkhead 13, is arranged on the side facing away from heating chamber 4 of the compressed gas power switch. The movement of cover plate 42 made of ferromagnetic material is limited by stop 46 with elastic body 45 between them, as shown by FIGS. 1 through 3.

Regardless of the design of current-dependent valves 31, 32, 33, they operate so that they keep blow hole 12 closed due to their cover plates 34, 38, 39, 42, made of ferromagnetic material, being attracted in the main current phase. However, if the switch-off current drops to a certain value, the force of compression spring 35, 40, 44 exceeds the forces of the current, or the forces generated between two ferromagnetic bodies in a magnetic field, so blow hole 12 is opened. In the embodiment of current-dependent valve 33 according to FIG. 8, opening of blow hole 12 is also supported by the pressure of the gas from heating chamber 4.

What is claimed is:

1. A compressed gas power switch for extinguishing a high short-circuit current arc, comprising:

a first switching part and a second switching part, the first switching part and second switching part arranged at a distance from one another along a common axis, the second switching part being axially displaceable and connected to a piston movable within a switching chamber, the piston being driven by hot gas flowing from a heating chamber into the switching chamber;

an axially displaceable contact part partially surrounded by the heating chamber, the axially displaceable contact part bridging the distance between the first switching part and the second switching part in an on state and moving away from the first switching part during a switch-off sequence, the second switching part moving away from the axially displaceable contact part when hot gas flows from the heating chamber into the switching chamber, wherein a first isolating distance is formed between the first switching part and the axially displaceable contact part, a second isolating distance being generated in series with the first isolating distance during actuation of the compressed gas power switch.

2. The compressed gas power switch according to claim 1, further comprising:

a bulkhead mounted on the axially displaceable contact part, the bulkhead separating the heating chamber from the switching chamber, the bulkhead having a valve controlled by a switchable current and a pressure difference between the heating chamber and the switching chamber.

3. The compressed gas power switch according to claim 2, wherein the valve includes at least one ferromagnetic part which keeps a blow hole in the bulkhead closed during a high-current phase against a force of compression springs.

4. The compressed gas power switch according to claim 2, wherein the valve is formed using forces generated between two ferromagnetic parts in a magnetic field, the valve being formed via two cover plates composed of ferromagnetic material which are displaceably opposed to one another in a radial direction with respect to the common axis on an end face of the bulkhead facing the switching chamber at a height of a blow hole, the two cover plates supporting one another through compression springs arranged one of perpendicular and parallel to the common axis.

5. The compressed gas power switch according to claim 2, wherein the valve is formed using forces generated between two ferromagnetic parts in a magnetic field, the valve being formed via a frame composed of ferromagnetic material, the frame having a concentric blow hole within a bulkhead, and a cover plate composed of ferromagnetic material, the cover plate being guided by rods attached to the bulkhead, supported against the bulkhead by compression springs arranged one of perpendicular and parallel to the common axis, the cover plate being arranged on the side facing the heat chamber upstream from the concentric blow hole.

6. The compressed gas power switch according to claim 1, wherein the second switching part is axially displaceable on an inner periphery of a tubular main current path coupled to a compression piston of a compression device forming a sliding contact, the second isolating distance being formed between the second switching part and the axially movable contact part after a blow hole has been opened by a current-dependent valve via the hot gas driving the piston, the piston being an annular piston.

7. The compressed gas power switch according to claim 6, wherein the annular piston is coupled to the compression piston of the compression device in the switching chamber via a compression spring.

8. The compressed gas power switch according to claim 6, wherein the switching chamber is downstream from the heating chamber and is delimited in a radial direction by a partition running coaxially with the common axis, the partition being fixedly connected to a bulkhead and to the compression piston of the compression device forming an additional heating chamber connected to the heating chamber upstream from the bulkhead on an outer periphery of the partition.

9. The compressed gas power switch according to claim 6, wherein the current-dependent valve includes a cover plate composed of ferromagnetic material, the cover plate slidingly arranged over the blow hole and supported by compression springs against the tubular main current path formed by the first switching part, the second switching part, and the axially movable contact part, the compression springs being arranged one of perpendicular and parallel to the common axis, movement of the cover plate being limited by a stop.

* * * * *